US005165649A

United States Patent [19]

Neumann et al.

[11] Patent Number: 5,165,649

[45] Date of Patent: Nov. 24, 1992

[54] DISPLAY STAND

[76] Inventors: Leslie S. Neumann, 9 Woodglen Dr., New City, N.Y. 10956; Harold H. Neumann, 555 North Ave., Ft. Lee, N.J. 07024

[21] Appl. No.: 812,645

[22] Filed: Dec. 23, 1991

[51] Int. Cl.[5] ..... A47B 97/04

[52] U.S. Cl. ..... 248/459; 206/45.26; 211/50

[58] Field of Search ..... 248/447.1, 461, 459, 248/463, 455, 456; 281/33, 45; 211/45, 50; 206/45.26; 220/6, 7

[56] References Cited

U.S. PATENT DOCUMENTS

| | | | |
|---|---|---|---|
| 21,271 | 2/1840 | Barrett . | |
| 1,146,103 | 7/1915 | Roy | 248/459 |
| 1,563,687 | 12/1925 | Chaney | 206/45.26 UX |
| 2,515,887 | 7/1950 | Moore | 206/45.26 |
| 3,017,148 | 1/1962 | Wathen . | |
| 3,097,444 | 7/1963 | Steiner | 248/459 X |
| 4,579,232 | 4/1986 | Fedak | 211/50 |
| 4,938,365 | 7/1990 | Conway | 211/50 |
| 4,962,859 | 10/1990 | Kump | 211/50 |
| 5,083,663 | 1/1992 | Conway | 220/6 X |

FOREIGN PATENT DOCUMENTS

| | | | |
|---|---|---|---|
| 477654 | 1/1938 | United Kingdom | 206/45.26 |

*Primary Examiner*—J. Franklin Foss
*Attorney, Agent, or Firm*—Stanley J. Yavner

[57] ABSTRACT

A display stand for supporting, proximate a computer or the like, written material to be used as input to that computer. The display stand is also usable to conveniently display reading material. Preferred and alternative embodiments of the invention feature, respectively, a self-contained display stand with lock-in back support, and a self-contained display stand with an interleaf storage feature, usable both to display material and also to contain and store computer disks. In either or both of the embodiments, elastic bands are attachable for holding the pages for a multi-page book.

7 Claims, 9 Drawing Sheets

FIG. 5
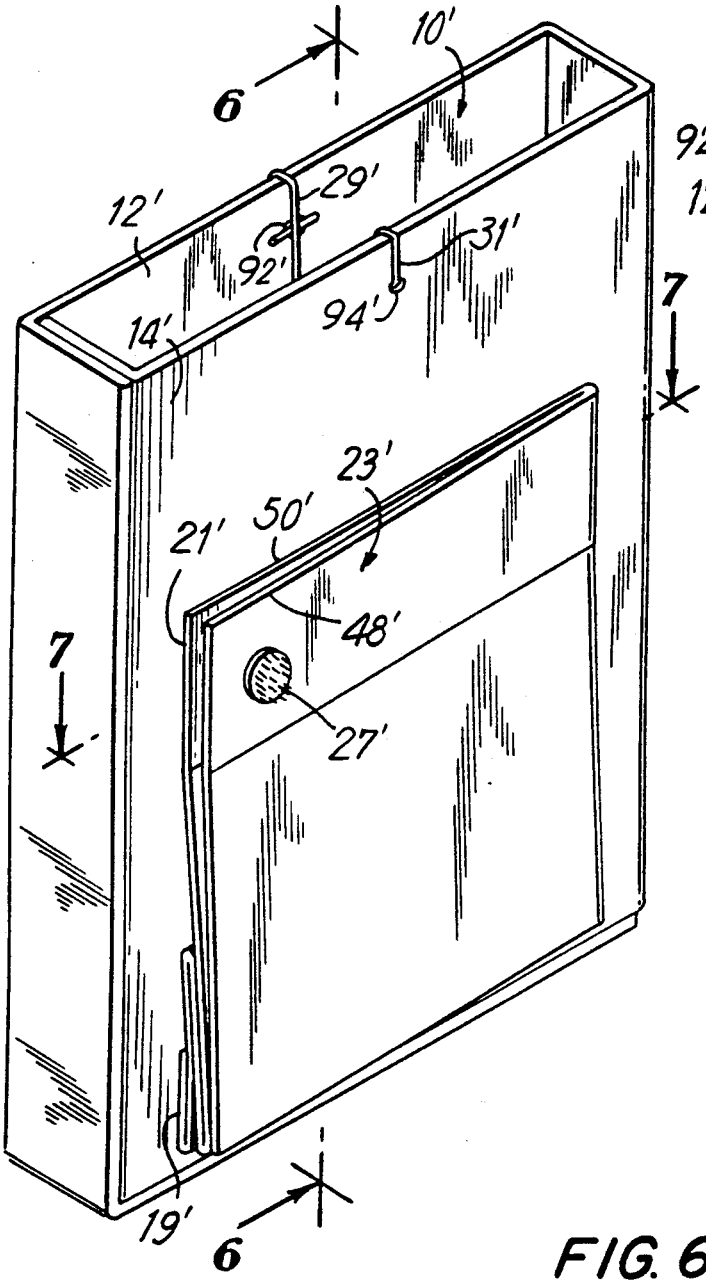
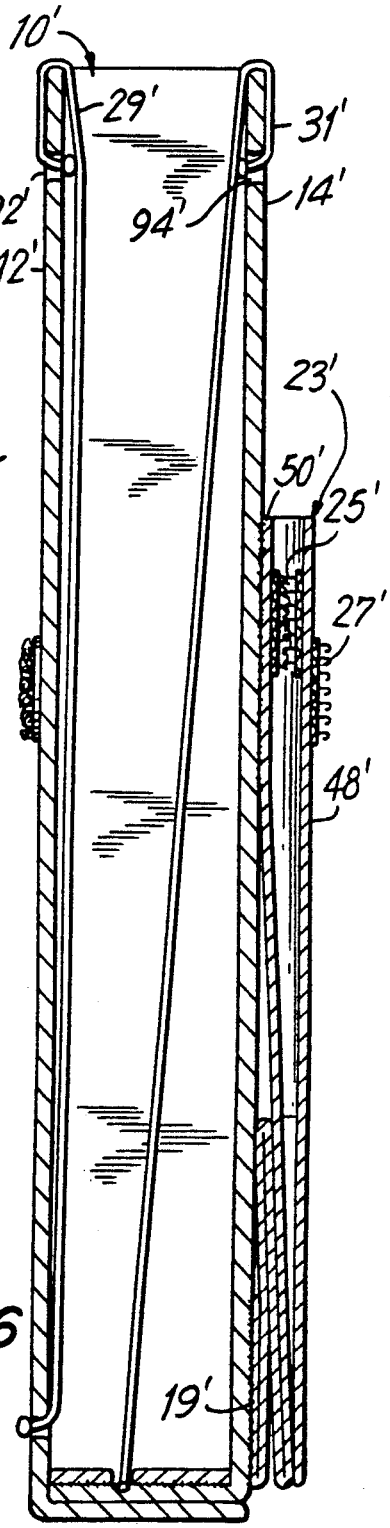
FIG. 6

DISPLAY STAND

FIELD OF THE INVENTION

This invention relates primarily to display stands and more particularly to display stands usable for supporting and displaying material to be used as input to a computer or as reading material.

PRIOR ART AND BACKGROUND OF THE INVENTION

With the advent of use of computers and peripheral equipment therefor, during the past ten or fifteen years, the efficiency of such use has constantly lagged behind the development of the computer equipment itself. By way of example, word processing computer equipment, in terms of electronics, has now advanced to the stage where a business office cannot survive without the use of such processors for generating final form reports and correspondence in today's office environment, noted for the vast increase in paper work generated. Sophisticated printers and illustrative capablity produce staggering amounts of reporting and correspondence detail; and yet, the materials and information used to input the processor are displayed to the input clerk, at best, by a spring-loaded clip that attaches, usually to the top side of the display screen.

Granted, technology exists for special purpose display stands which, with some difficulty, may be adapted for displaying input material for a computer or a word processor. An example of this is a patent entitled "DISPLAY DEVICE", inventor, Ernest L. Wathen, U.S. Pat. No. 3,017,148, issued Jan. 16, 1962, wherein an advertising display is presented. However, even though the general technology is adaptable to the objects of the present invention, with cut-out, unitary structure, the particular form, rigidity and support details of the Wathen invention is not particularly adaptable or usable for displaying input material to a computer, or for displaying reading material.

Likewise, Barrett U.S. Pat. Re. No. 21,371, issued Feb. 27, 1940, presents a particular form of portable display device for use in displaying loose-leaf arranged reading material; but again, the particular form, rigidity and support details of the Barrett invention would not be particularly usable or adaptable to displaying reading material on a clerical desk in an office, or for displaying input material for a word processor or a computer.

SUMMARY OF THE INVENTION

Accordingly, a primary object of the present invention is to provide a display stand construction, particularly useful for displaying reading material in an office environment, or for displaying input material for a word processor or computer, considering particularly the space availability in an office environment and such space availability as it pertains to computer work stations.

A further object of the present invention is to provide a display stand, which is convenient to store, efficient in its set-up construction and able to display office reading materials or input materials for a computer or word processor.

These and other objects of the present invention are accomplished in a display stand construction which features a flat, rigid, cut-out cardboard or the like, display construction sheet, with capabilities for repeated folding and support structure to hold papers, magazines, reports and the like, in a readable position in an office environment. More particularly, the display stand construction according to the preferred embodiment features display stand support wings cut out from the base material, defining notches for attachment to a foldable bottom section of the base material, defining matable notches. Furthermore, the preferred embodiment features a construction which is foldable into a front extending side and bottom page support for the material to be displayed.

An alternative embodiment features a more rigid structure which is also used to store computer disks, and which additionally features fold-out support wings fixedly attached to one side only of the display stand, but which is attachable to the other side as well, with Velcro fasteners, or the like.

It should be understood that the present invention is useful for displaying magazines, manuals and textual material to be read while performing manual tasks such as equipment training, cooking, crafts, music, etc. It is also useful for the infirm in hospitals and for educational purposes in schools and libraries, in addition to use for all of these tasks while travelling (it is easily portable).

BRIEF DESCRIPTION OF THE DRAWINGS

Other objects, features and advantages of the present invention will become apparent by the following detailed, but nonetheless illustrative description of the preferred and alternative embodiments, referencing the accompanying drawings, wherein:

FIG. 5 is an isometric view of an alternative embodiment of the present invention, featuring particularly a construction capability lending itself to the storage of computer disks or the like;

FIG. 6 is a side sectional view taken along the line 6—6 of FIG. 5;

DETAILED DESCRIPTION OF THE PREFERRED AND ALTERNATIVE EMBODIMENTS

Figure 1:
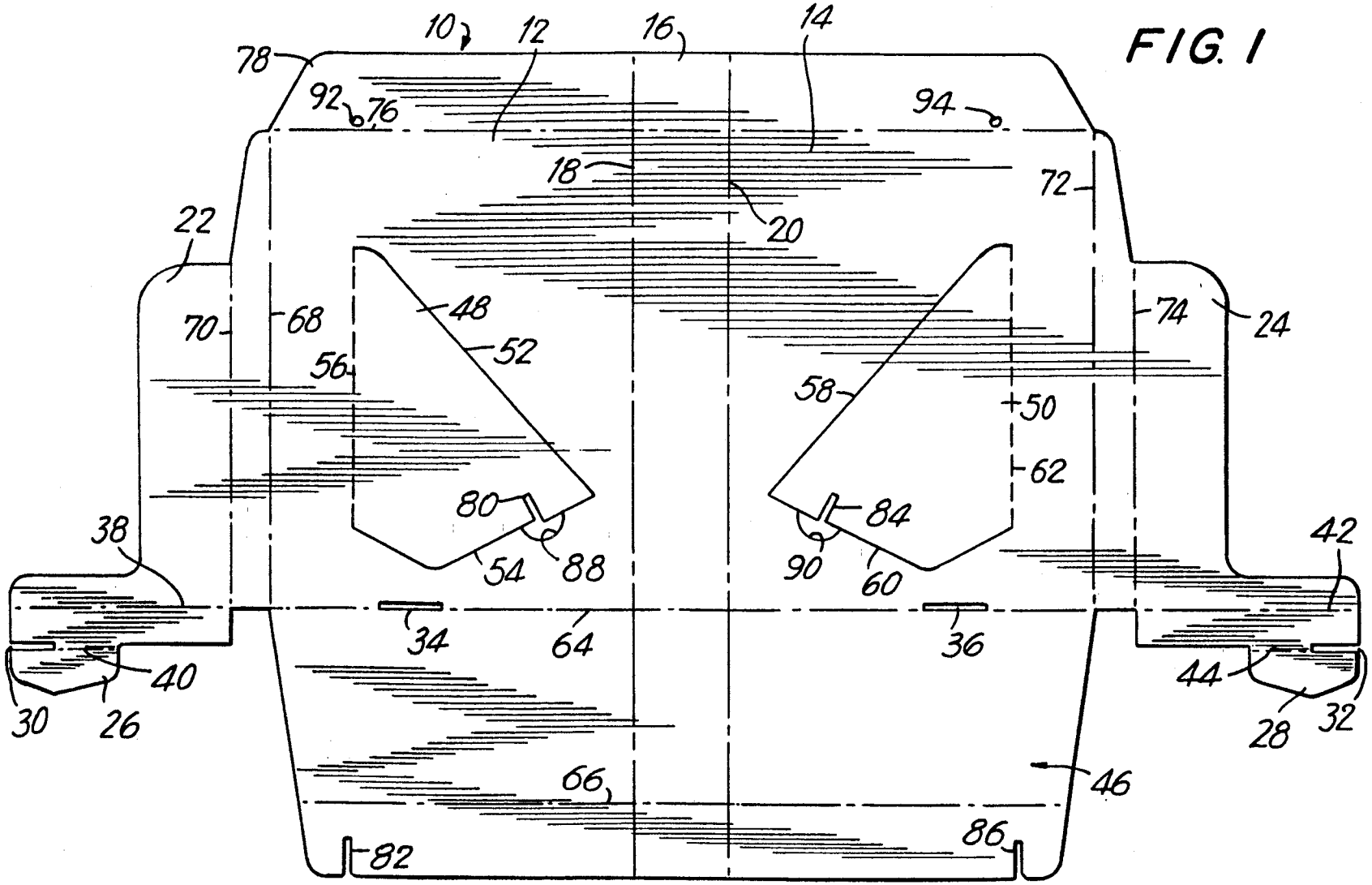
FIG. 1 is a plan view of the unassembled construction for the preferred embodiment of a display stand according to the present invention.

Referring to the drawings, and particularly FIGS. 1–4 thereof, a display stand is shown as formed from a single sheet of flat rigid material, generally designated 10, such as cardboard, or the like. In more detail, base material 10 may be constructed of chipboard, and can be covered with either fabric or printed sheets. Base material 10 is generally formed in two symmetrical parts 12, 14 separated by center portion 16 defined by fold lines 18, 20. Each part 12, 14 has appended to its outermost side connecting wing 22, 24, with each connecting wing defining connecting extension 26, 28 and notch 30, 32. In first part 12 a notch receptacle 34 is defined in order to mate with connecting notch 30 and connecting extension 26. Likewise, notch receptacle 36 and part 14 is intended for mating with connecting notch 32 and connecting extension 28. Thus, elements 26–36 facilitate, with fold lines 38, 40 on part 12, and 42, 44 on part 14, the formation of bottom section generally designated 46.

This enables the bottom support for the display stand according to the present invention, and works in conjunction with support wings 48, 50 to support the display stand in usable position. Support wings 48, 50 are defined by cut lines 52, 54, and fold line 56, defined by part 12; and cut lines 58, 60 and fold line 62 in part 14, defining support wing 50 for that portion of the display stand.

Fold lines 64, 66 enable bottom section 46 to be manipulated into usable position; fold lines 68, 70 and fold lines 72, 74, respectively enable the folding of connecting wings 22, 24 into usable position for the display stand.

Likewise, fold line 76 enables stiffening portion 78 to be folded backwardly of the display stand for providing rigidity to the entire structure.

When the structure is completely assembled, folded and connected, notch 80, defined by support wing 48 mates with notch 82 defined by bottom section 46. Similarly, notch 84 mates with notch 86. Finger holes 88, 90 are defined, respectively, by parts 12, 14 in order to facilitate the folding to usable position of support wings 48, 50.

In order to provide a more complete description of the preferred embodiment of the present invention, a series of set-up and use steps, with respect to FIGS. 1–4 are now provided.

The display base material 10 of the present invention is folded, with stiffening portion 78 folded rearwardly (in the orientation of FIG. 1), fold lines 68, 72 folded frontwardly, and then connecting wings 22, 24 are folded toward the center portion 16 of the material. Connecting extensions 26, 28 are folded forwardly in order to fit into notches 34, 36, thus to provide the outward and bottom page supports for the material being read or being used as input material for a computer or the like.

Finger notches 88, 90 facilitate the rearward folding of support wings 48, 50, along fold lines 56, 62, respectively, in order to place such support wings rearwardly of the display stand for connection of notch 80 to notch 82, and notch 84 to notch 86.

Figure 2:
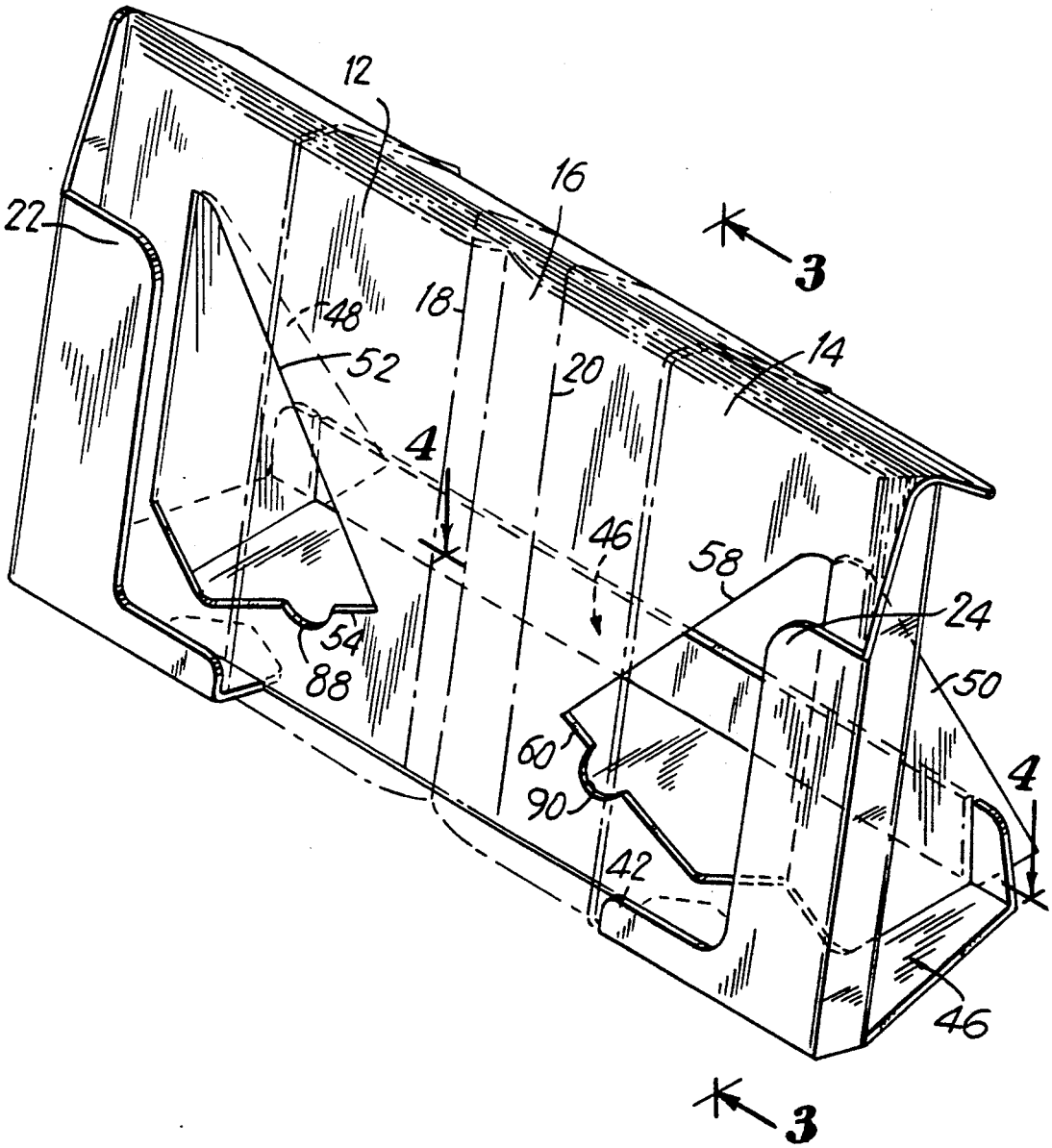
FIG. 2 shows the display stand of FIG. 1 in set-up form for use to display reading material or input material for a computer in an office environment.
Figure 3:
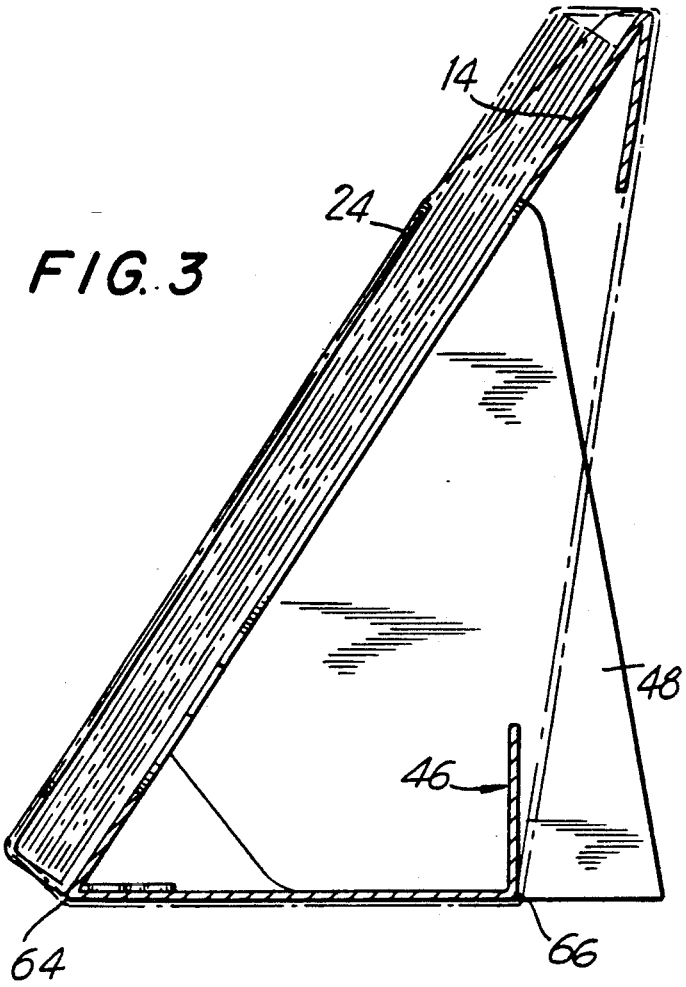
FIG. 3 is a side sectional view taken along the line 3—3 of FIG. 2.
Figure 4:
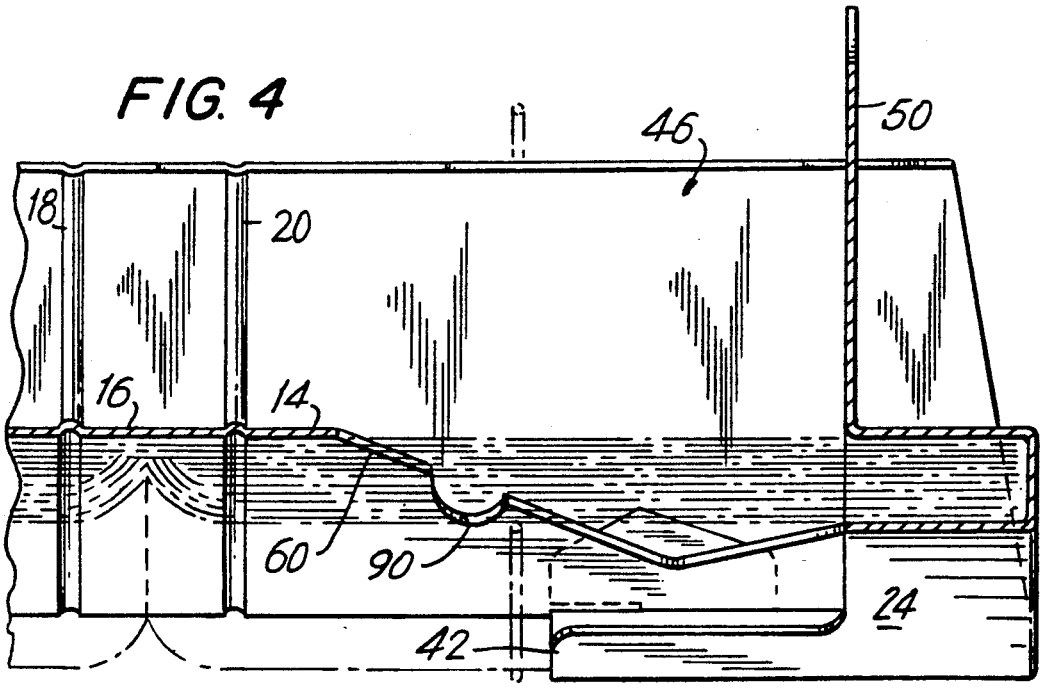
FIG. 4 is a partial sectional view of the display stand of FIG. 1, taken along the line 4—4 of FIG. 2.
Figure 7:
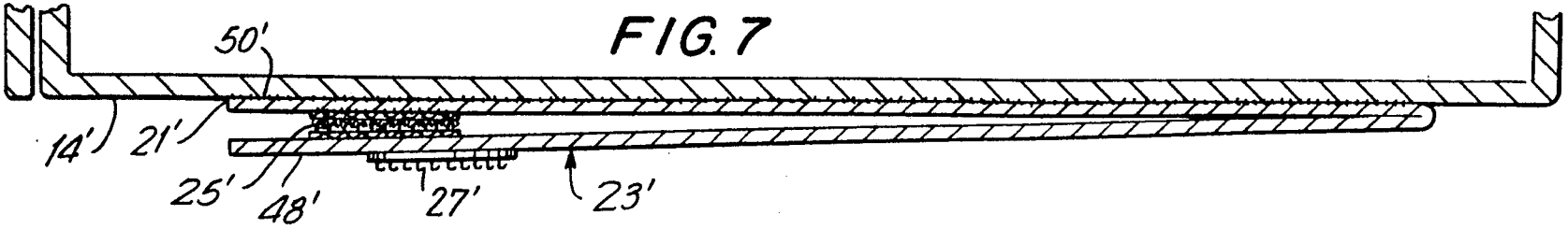
FIG. 7 is a top sectional view taken along the line 7—7 of FIG. 5.

Accordingly, the display stand set-up process moves from FIG. 1, to the position shown in FIG. 2, and then to the positions shown in FIGS. 3 and 4.

It should be mentioned that openings 92, 94, defined by stiffening portion 78 are intended for holding and guiding an elastic band, or the like, (not shown) in order to further hold the pages being read and held by the display stand in flat position for convenient use. As will be described with reference to FIGS. 5 and 6, a similar elastic band is used with the alternative embodiment, and defines with more specificity and detail what is not shown, but could be used in the preferred embodiment of FIGS. 1–4.

Referring to FIGS. 5–10, an alternative embodiment of the present invention is presented, including a more rigid base material generally designated 10', divided approximately into two equal parts 12', 14', separated by center portion 16', defined by fold lines 18', 20'. In use position and orientation, the back of the base material, particularly part 14', has affixed to it, at points 19', 21', a support wing construction, generally designated 23'. The support wing construction 23' is generally divided into two halves 50', 48'. In the closed position shown in FIGS. 5–7, wherein a storage capability for computer disks is provided, part 14' is embraced by part 12' in order to form a container-type structure. In that position, support wing 48' is attached by Velcro fasteners or the like 25', with a single Velcro fastener 27' exposed outwardly of part 48'.

Also included within the alternative embodiment structure is an elastic page holder 29', 31' for each part 12', 14', extended through openings 92', 94', defined respectively in parts 12', 14'.

Figure 8:
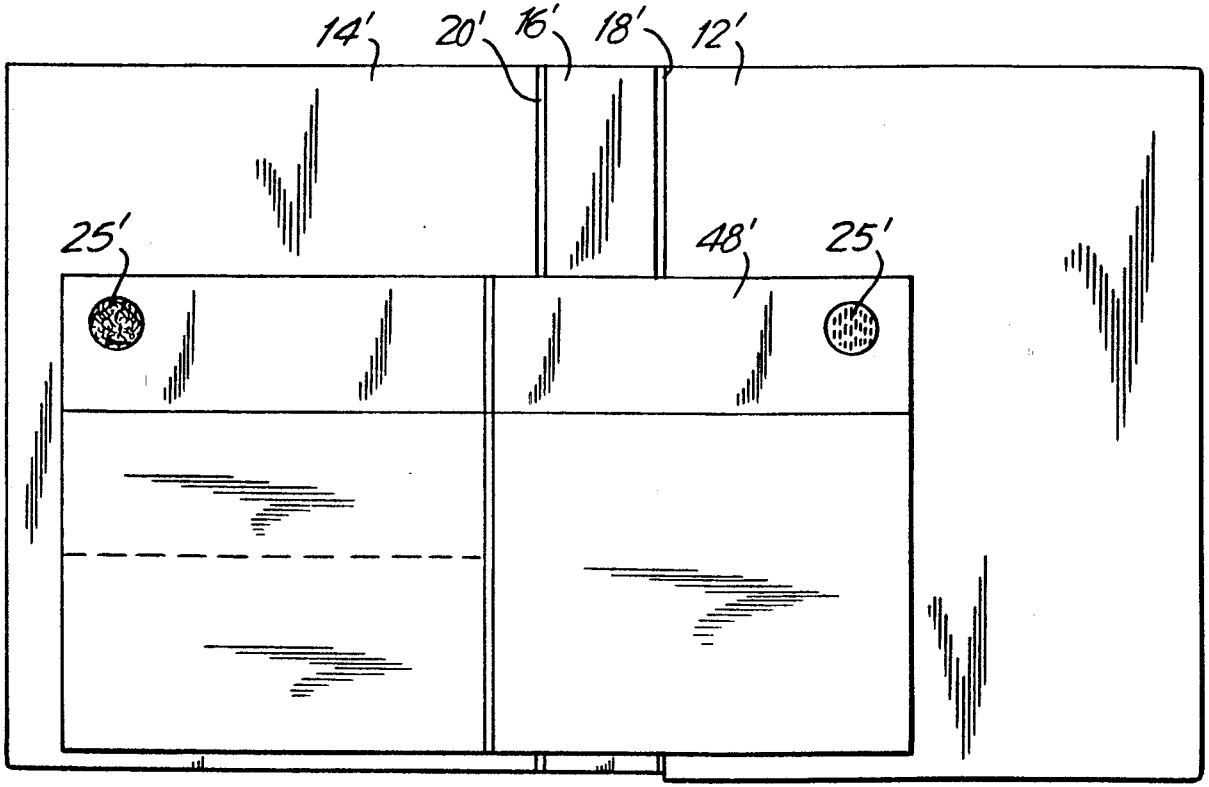
FIG. 8 is a back view of the display stand of FIG. 5, in set-up form, showing particularly the attachability feature for the support wing thereof.
Figure 9:
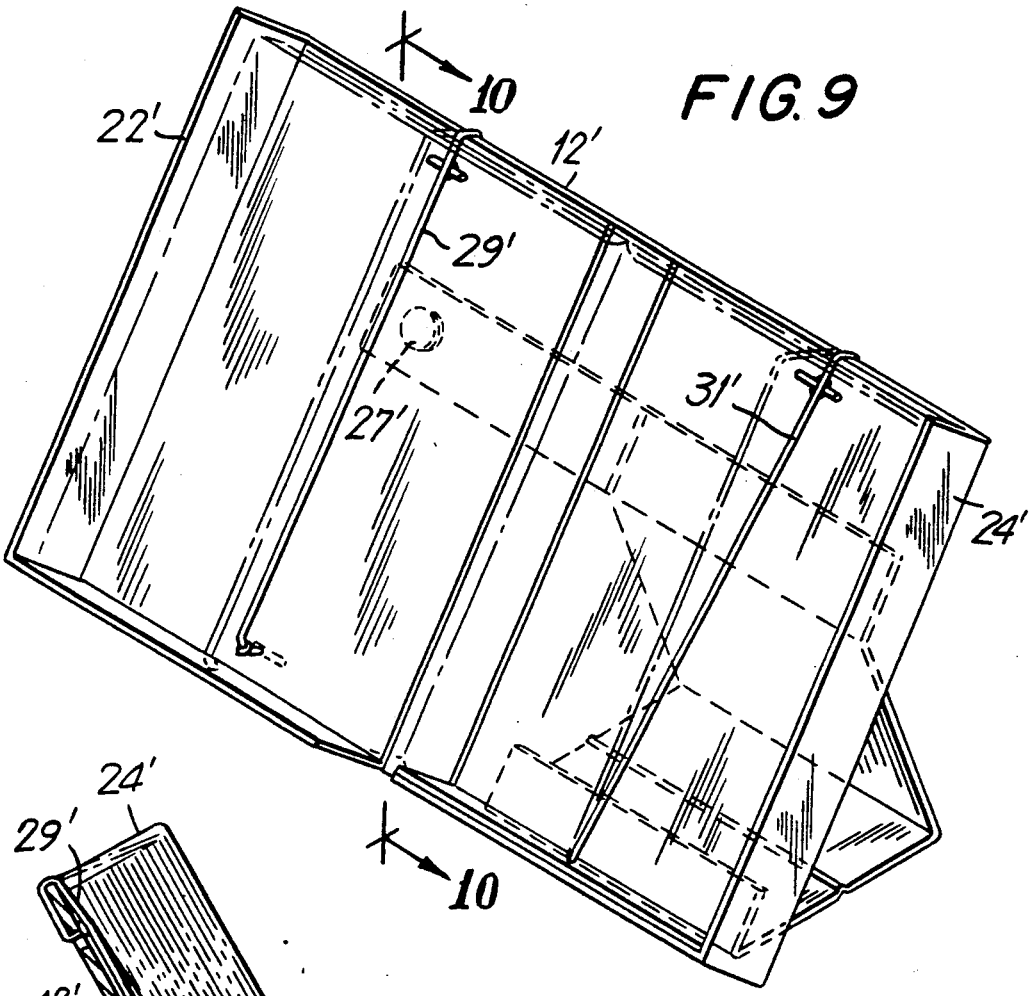
FIG. 9 is a front, isometric view of the display stand of FIG. 5 showing particularly the book display capability, and particularly showing the page support feature thereof.
Figure 10:
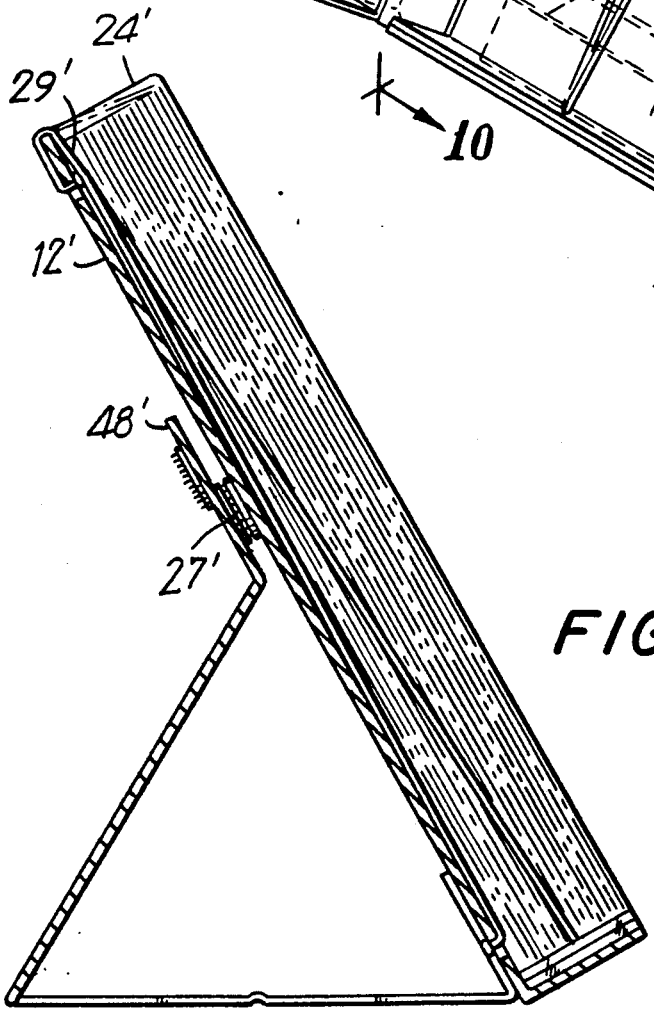
FIG. 10 is a side sectional view of the display stand of FIG. 9, taken along the line 10—10 of FIG. 9.

In order to provide a more complete description of the alternative embodiment, a series of set-up and use steps are now provided. FIGS. 8–10 illustrate the use position whereby Velcro fastener 27' is used to attach part 48' to part 12', so that the display stand construction according to the alternative embodiment is supported as shown in FIGS. 9 and 10, with elastic band 31' and elastic band 29' in position, with connecting wings 22', 24'; for holding in reading position the pages of a book inserted to the front opening defined by the front face of the structure.

A further alternative embodiment is shown in FIGS. 11–14, which is quite similar to the embodiment shown in FIG. 1–4, but with larger front connecting wings 22", 24", for use with magazines or manuals, or the like, having larger, less rigid page structure.

Figure 11:
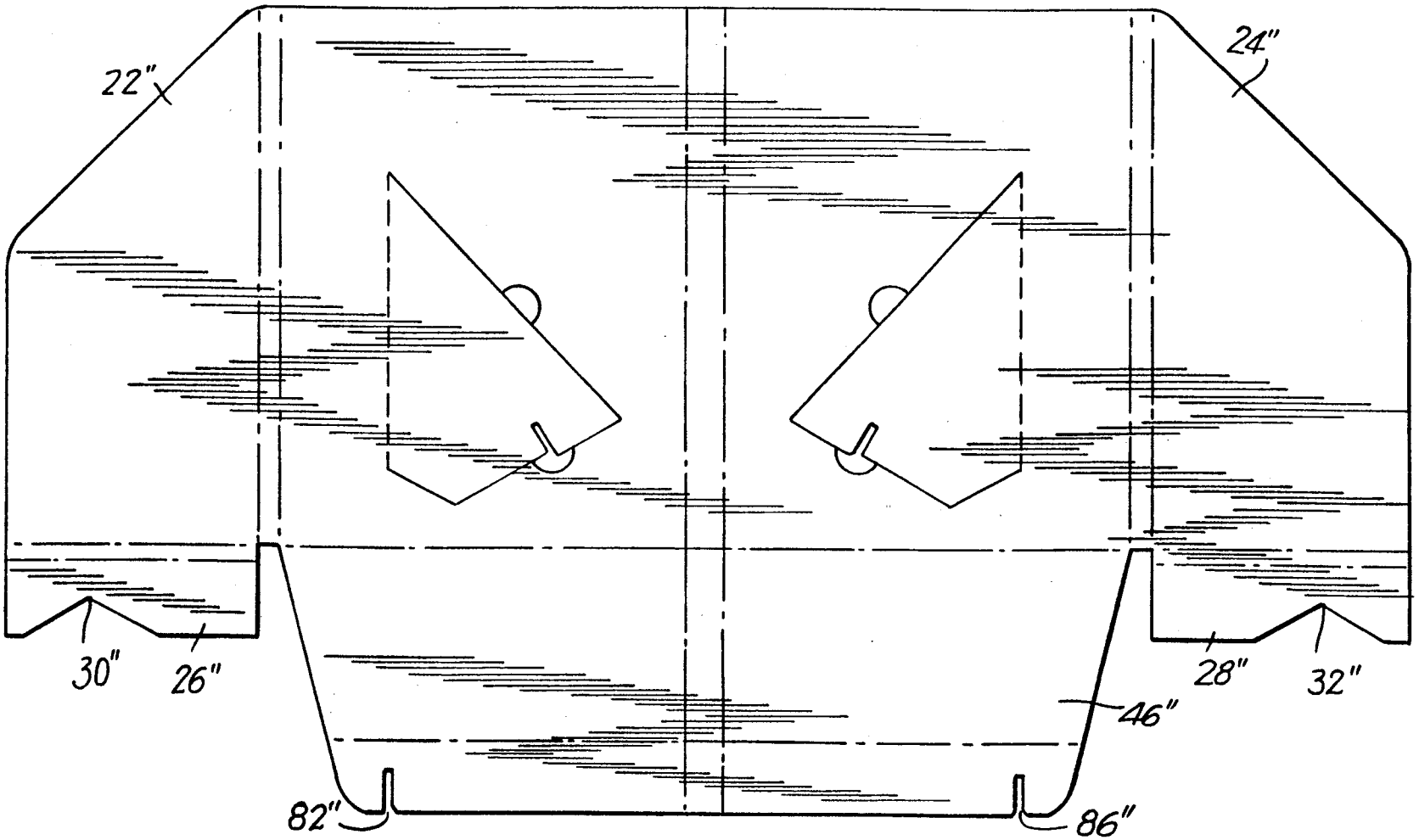
FIG. 11 is a further alternative version of a display stand according to the present invention, similar to that of FIG. 1-4, but with a a slightly different support wing form of attachment to the bottom support, and a variation of the support page construction.
Figure 12:
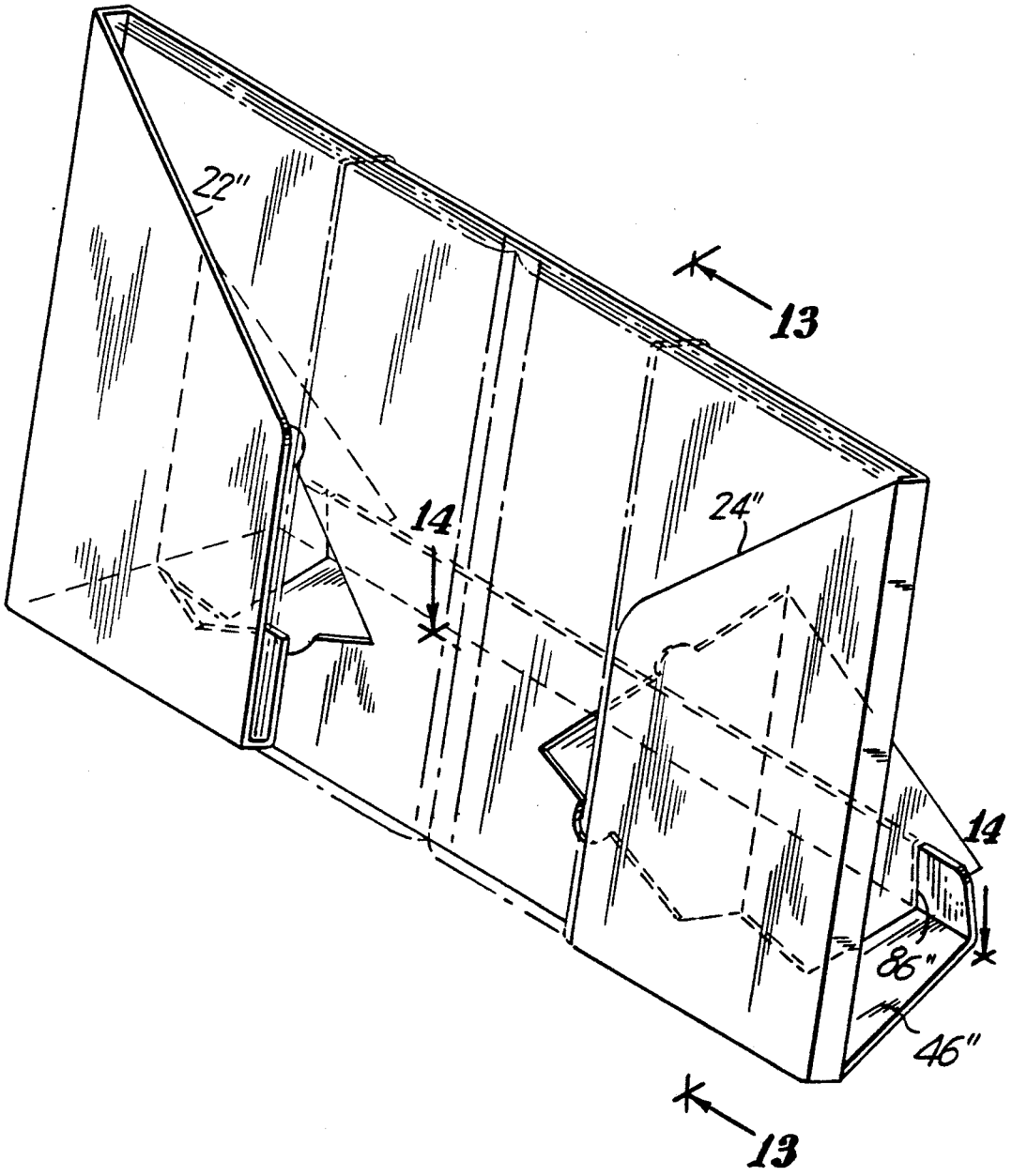
FIG. 12 shows the display stand of FIG. 11 in set-up form.
Figure 13:
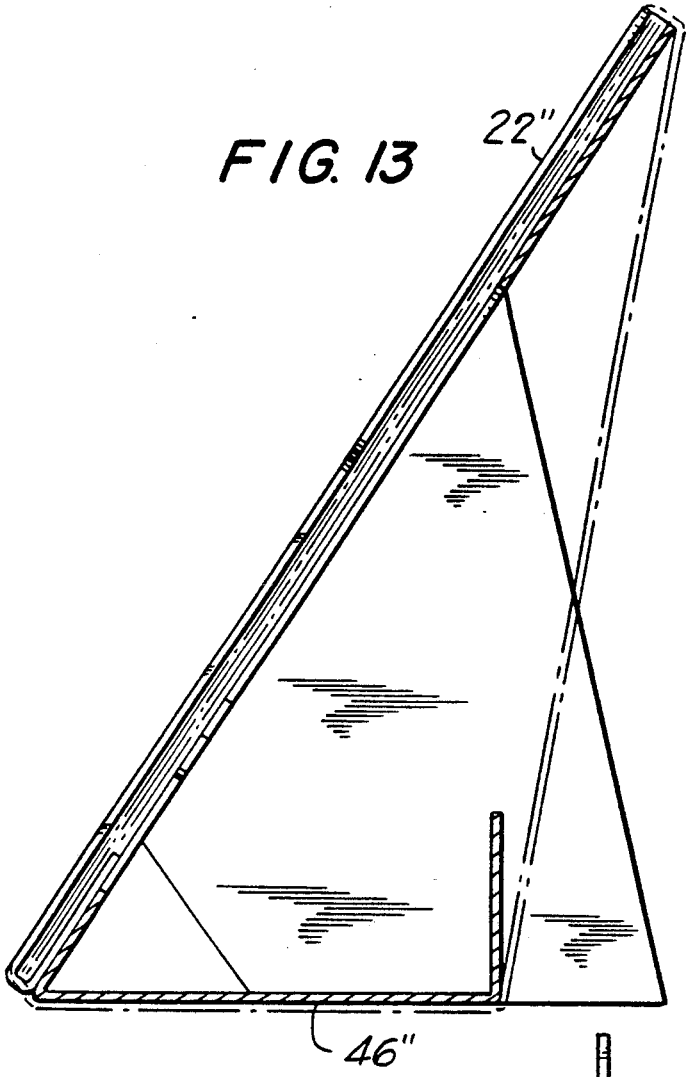
FIG. 13 is a side sectional view of the display stand of FIG. 12, taken along the line 13—13 of FIG. 12.
Figure 14:
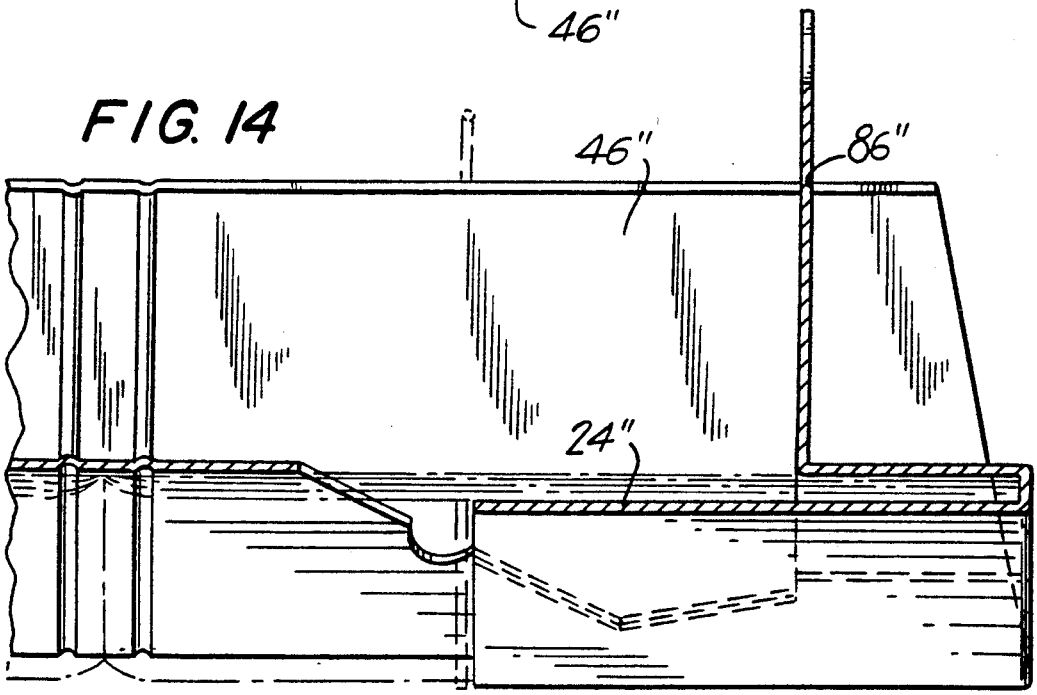
FIG. 14 is a partial, top sectional view of the display stand of FIG. 12, taken along the line 14—14 of FIG. 12.

In other respects, this alternative embodiment is quite similar to the embodiment shown in FIGS. 1–4; but, of course, as shown most clearly in FIG. 11, connecting extensions 26", 28" define notches 30", 32" of a different shape for mating with notches 82", 86" on bottom section 46".

Therefore, a multiplicity embodiments of the present invention have been described, with various shapes and structures; but, the invention is to be limited only by the following claims, rather than the particulars described in the foregoing.

What is claimed is:

1. A display stand for displaying reading material and computer input material in a confined environment comprising a unitary construction including a pair of symmetrical parts, each part defining a pair of support wing portions, said parts separated by a fold line defined by said construction, a pair of connecting wing portions outwardly of said support wing portions for use in retaining said material in observable and usable position, all adapted and arranged so that said support wing portions extend rearwardly of said display stand for supporting said display stand in a self-sustaining, standing position.

2. The invention according to claim 1 wherein each of said connecting wing portions have appended to them a connecting extension, defining a connecting extension notch, each of said parts defines a notch receptacle, said notches fitting into said notch receptacles for providing the use of said connecting extensions to retain, with said support wing portions, said material in a readable position.

3. The invention according to claim 1 wherein said support wing portions are, together, fixedly connected to one of said parts, and foldable and otherwise additionally connectable to support said parts in order to display said material.

4. The invention according to claim 3 wherein detachable connectors are used for said connecting wings, in order to make them additionally connectable.

5. The invention according to claim 3 wherein said connecting wing portions are at right angles to said parts.

6. The invention according to claim 1 wherein each of said parts defines an opening and an elastic band is inserted through said opening for additionally holding said material in usable position, and during storage and transportation of said reading material.

7. The invention according to claim 1 wherein each of said parts defines a finger opening proximate said support wing portion for facilitating the set-up of said display stand.

* * * * *